US007685785B2

(12) United States Patent
Johnson

(10) Patent No.: US 7,685,785 B2
(45) Date of Patent: Mar. 30, 2010

(54) ROOF UNDERLAYMENT

(76) Inventor: Terry R. Johnson, 725 Riverside Dr., Stuart, FL (US) 34994

( * ) Notice: Subject to any disclaimer, the term of this patent is extended or adjusted under 35 U.S.C. 154(b) by 851 days.

(21) Appl. No.: 11/268,882

(22) Filed: Nov. 8, 2005

(65) Prior Publication Data

US 2006/0096218 A1 May 11, 2006

Related U.S. Application Data

(60) Provisional application No. 60/625,850, filed on Nov. 8, 2004.

(51) Int. Cl.
*E04B 5/00* (2006.01)

(52) U.S. Cl. ..... 52/409; 52/506.01; 52/746.11

(58) Field of Classification Search ..... 52/408, 52/409, 506.01, 746.11, 746.1; 428/40.1, 428/42.2, 40.3
See application file for complete search history.

(56) References Cited

U.S. PATENT DOCUMENTS

| | | | | |
|---|---|---|---|---|
| 3,434,259 | A * | 3/1969 | Corbin | 52/420 |
| 5,305,569 | A | 4/1994 | Malmquist et al. | |
| 5,766,729 | A | 6/1998 | Zanchetta et al. | |
| 5,843,522 | A | 12/1998 | Zanchetta et al. | |
| 5,964,946 | A | 10/1999 | Zanchetta et al. | |
| 6,425,213 | B1 | 7/2002 | Lachapelle | |

(Continued)

OTHER PUBLICATIONS

Stephanie Herzfeld, "Exterior Products Review: Self-Adhered Roof Underlayments", Building Products Magazine, Sep. 27, 2004.

(Continued)

*Primary Examiner*—David Dunn
*Assistant Examiner*—Daniel Kenny
(74) *Attorney, Agent, or Firm*—Dickinson Wright PLLC

(57) ABSTRACT

An underlayment sheet (10, 10') is applied in overlapping courses to a roof deck (36) for establishing a weather-resistant membrane for use as a final exposed surface or below a roof covering (50). The underlayment sheet (10, 10') has a bottom surface (16, 16') to which a pressure sensitive adhesive section (22, 22') is applied generally continuously along its length. A non-adhesive section (24, 24') also extends the length of the bottom surface (16, 16') adjacent its upper long edge (18, 18') for providing a contact surface with the roof deck (36) which is devoid of any adhesive material. The non-adhesive section (24, 24') is attached to the roof deck (36) using tin tags (44, 44') or other mechanical fastening components. When subsequent underlayment sheets (10, 10') are applied in overlapping courses, the adhesive sections (22, 22') bond over the preceding underlayment sheet (10, 10') to establish a water tight seal. The top surface (14) of the underlayment sheet (10) may include a supplemental bonding strip (30) which adheres directly to the adhesive section (22) of an overlying underlayment sheet (10) to establish a tenacious seal. The top surface (14') may also be impregnated with a course granular material (52) to serve as a final, exposed surface for the roof in lieu of shingles or the like. If a future re-roofing operation is required, the subject underlayment system can be removed from the roof deck (36) without damaging or delaminating the roof deck (36) material.

16 Claims, 5 Drawing Sheets

U.S. PATENT DOCUMENTS

| | | | | |
|---|---|---|---|---|
| D479,685 | S | 9/2003 | Zanchetta et al. | |
| 6,696,125 | B2 | 2/2004 | Zanchetta et al. | |
| 6,871,472 | B2 | 3/2005 | Folkersen | |
| 6,924,015 | B2 | 8/2005 | Zanchetta et al. | |
| 6,936,329 | B2 | 8/2005 | Kiik et al. | |
| 2003/0008094 | A1* | 1/2003 | Zickell | 428/40.1 |
| 2003/0219564 | A1* | 11/2003 | Hubbard | 428/40.1 |

OTHER PUBLICATIONS

Fast90 2 Ply Tile Underlayment Specification, Tarco, Little Rock, AR.
Fast90 Tile Underlayment, Tarco, Little Rock, AR.
Elk All Climate Underlayment Specifications, Elk Corp.
AItUSA Field Tile, www.altusa.com.
Peel and Stick Underlayment, Interwrap, Inc.

* cited by examiner

ROOF UNDERLAYMENT

CROSS REFERENCE TO RELATED APPLICATIONS

This application claims the benefit of priority to U.S. Provisional Application No. 60/625,850 filed Nov. 8, 2004.

BACKGROUND OF THE INVENTION

1. Field of the Invention

The invention relates to an underlayment sheet of the type applied in overlapping courses to a roof deck for a building structure, and more particularly toward such an underlayment sheet of the self-adhering type used to enhance water and weather resistance capabilities of the roof system.

2. Related Art

In typical pitched roof applications for residential and commercial buildings, a water-resistant membrane in the form of an underlayment sheet is installed between the roof deck and the outer roof covering. In some applications, the underlayment may even comprise the final roofing layer without any shingles or other coverings applied over top. The underlayment sheet is typically applied in overlapping courses and is designed to help the roof shed water and provide secondary weather protection.

In applications where water issues are a particular concern, either from ice damming or low-slope roof pitches, or severe weather encounters, various special underlayment techniques have been proposed. More traditionally, a two-ply underlayment system known as the 30/90 hot mop system is used. In this system, a base sheet of 30 lb traditional underlayment material is affixed to a plywood or OSB roof decking with so-called "tin tag" or "cap nail" fasteners to provide mechanical attachment directly to the decking. The 30 lb underlayment sheets are applied in overlapping courses beginning at the bottom (eaves) edge and working in parallel rows toward the ridge. After the 30 lb underlayment sheet has been installed, a roofing contractor applies hot asphalt over the entire surface. The asphalt may be heated to 525° F., typically, at which temperature the hot, runny asphalt poses a significant burn issue to workers on and around the roof. A 90 lb underlayment material is then applied directly over the hot, unset asphalt to establish a bonded two-ply system. This traditional method usually requires two trips to the job site and different crews to apply first the 30 lb underlayment sheet in overlapping courses and then later the hot asphalt with 90 lb top layer. Additionally, different equipment is used for the different phases. A roof may not be considered water tight until the complete two-ply system has been installed.

A more recent underlayment system has been proposed for establishing a water-proof underlayment, which is known generally as the peel and stick method. Originally intended for applications in which ice damming was a concern, the peel and stick underlayment products have found increased acceptance in warmer client markets to help shed roof water such as may be encountered in storm conditions, and which may be more problematic in low-slope situations where water accumulation tends to be more of an issue. Typically, the peel and stick underlayment is designed to be installed sticky side down directly to the plywood decking in overlapping courses. Some in the industry suggest that such peel and stick products cause less harm to the roof deck than traditional underlayment systems because they are less susceptible to corrosion. In addition, they are not installed with nails or screws so they do not weaken the deck or transfer heat to the interior which could make air conditioning systems less efficient. Also, there are no holes that could allow moisture to seep in. Accordingly, while the peel and stick products have been touted as an effective improvement over the traditional two-ply 30/90 hot mop system, many local building codes have opposed use of the peel and stick underlayment directly upon the plywood decking. Many municipalities are requiring a base sheet of traditional (organic felt or fiberglass) underlayment sheet anchored with nails to the roof decking prior to applying the peel and stick products over top. Code bodies reason that when it is time for a re-roof, the peel and stick applied directly to the roof decking will cause delamination damage to the plywood or OSB decking. Delamination of the decking could lead to replacement of the plywood decking, thus driving the cost of future re-roofs up significantly. If used in this code-approved fashion, the peel and stick underlayment is hardly more economical than the traditional 30/90 hot mot two-ply system.

Accordingly, there is a need for an improved waterproof or water-resistant underlayment system for roof structures which is less expensive than the current peel and stick products used according to code recommendations, and less complicated and dangerous to apply than the 30/90 hot mop two-ply systems. Furthermore, there is a need to provide such a waterproof underlayment system which is not likely to cause delamination damage to plywood/OSB decking, thereby facilitating future re-roof projects. Furthermore, there is a need for a waterproof underlayment system which uses fewer nails or screws than current methods, thereby increasing the strength of the deck and diminishing heat transfer to the building interior.

SUMMARY OF THE INVENTION AND ADVANTAGES

The subject invention comprises an underlayment sheet of the type applied in overlapping courses to a roof deck for establishing a weather-resistant membrane below a visible roof covering such as shingles, sheet metal, clay or cement tiles, or the like. The underlayment sheet comprises an elongated flexible carrier having a top surface and a bottom surface bounded by opposing upper and lower long edges. A pressure sensitive adhesive section is disposed generally continuously along the length of the bottom surface, adjacent the lower long edge, and adapted for surface-to-surface contact with the top surface of a preceding one of the underlayment sheets in an overlapping course configuration. A non-adhesive section extends continuously along the length of the bottom surface, adjacent the upper long edge. The non-adhesive section is juxtaposed alongside the adhesive section and is adapted for direct surface-to-surface contact with the roof deck.

The subject underlayment sheet overcomes the disadvantages and shortcomings of the prior art peel and stick products in that the non-adhesive section on the bottom side can be attached directly to the roof deck using tin tags, cap nails, regular roofing nails, screws or other mechanical fasteners. The adhesive section establishes a waterproof joint with an underlying course. When finished, a roof is completely waterproofed via the overlapping adhesive connections, requiring but a single layer of the underlayment sheet. In other words, the traditional two-plys of underlayment found in both hot mop and code approved peel and stick systems are not required with this concept. Furthermore, there is no danger of hot asphalt spilling upon workers, and only one crew is required to install the underlayment in a single application.

According to a second aspect of the invention, a weather resistant roof system is provided for a building structure. The roof system comprises a roof deck and a plurality of underlayment sheets applied in overlapping courses upon the roof deck. Each underlayment sheet includes an elongated flexible carrier having a top surface and a bottom surface. A pressure sensitive adhesive section is disposed generally continuously along the length of the bottom surface, and a non-adhesive section extends continuously along the length of the bottom surface, juxtaposed alongside the adhesive section. At least one of the underlayment sheets lays with its adhesive section in surface-to-surface contact with the top surface of an adjacent one the underlayment sheets and the non-adhesive section thereof in surface-to-surface contact with the roof deck. A roof covering, such as singles, sheet metal, clay or cement tiles, or the like, is disposed on top of the underlayment sheets for establishing a durable exposed facade.

According to yet another aspect of the invention, a method for installing underlayment sheets in overlapping courses to a roof deck is provided for establishing a weather-resistant membrane below a visible roof covering such as shingles, sheet metal, tiles, or the like. The method comprises the steps of applying a first underlayment sheet along a generally linear course upon the roof deck and mechanically fastening the first underlayment sheet to the roof deck. A second underlayment sheet is applied along a generally linear course upon the roof deck, and overlapping a parallel portion of the first underlayment sheet. The second underlayment sheet is mechanically fastened to the roof deck as well. The method includes the step of bonding the overlapping parallel portion of the first and second underlayment sheets to one another with a pressure sensitive adhesive to establish a durable joint.

Accordingly, an underlayment sheet, roof system and method according to the subject invention overcomes the shortcomings and disadvantages found in the traditional 30/90 hot mop two-ply system as well as the shortcomings of the current peel and stick underlayment technologies. The subject invention provides a durable, weather-resistant membrane over the roof deck, at lower cost and with less manpower than required with the current systems. The subject invention is therefore less expensive to apply. Furthermore, the subject invention is less dangerous to apply than the traditional 30/90 hot mop system.

BRIEF DESCRIPTION OF THE DRAWINGS

These and other features and advantages of the present invention will become more readily appreciated as the same becomes better understood by reference to the following detailed description when considered in connection with the accompanying drawings, wherein.

DETAILED DESCRIPTION OF THE PREFERRED EMBODIMENT

Figure 1:
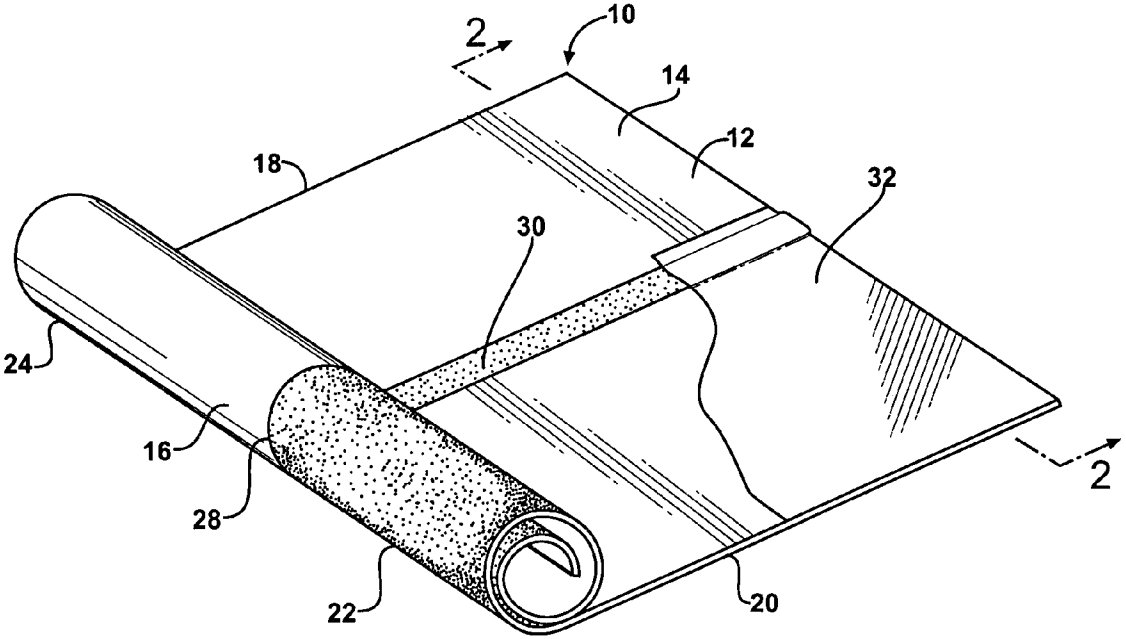
FIG. 1 is a perspective view of an underlayment sheet according to the subject invention showing a left edge thereof in a partially rolled condition to expose the bottom surface having both adhesive and non-adhesive sections.

Referring to the Figures, wherein like numerals indicate like or corresponding parts throughout the several views, an underlayment sheet according to the subject invention is generally shown at 10 in FIGS. 1, 2, 6 and 7. The underlayment sheet 10 is of the type to be laid down on a bare roof deck before shingles or other roof coverings are installed to provide additional protection for the deck. The underlayment sheet 10 is generally formed as an elongated, strip-like product which is sold in rolls as suggested by the curled edge in FIG. 1. The underlayment sheet 10 is unrolled over a roof deck and applied in overlapping courses to establish a weather-resistant membrane below a visible roof covering which may be of any type including shingles, sheet metal, clay or cement tiles, or the like. It will be appreciated, however, that some applications such as low slope carports and the like may suffice to use the subject underlayment sheet 10 as a final covering. That is, in some instances it may be desirable to omit the shingles, sheet metal, tiles or the like overtop of the subject underlayment sheet 10.

The underlayment sheet 10 has, as its main body, an elongated flexible carrier 12 which may be of any standard construction, such as a fibrous material saturated with tar or asphalt. In fact, any known construction for underlayment fabric may be used to construct the carrier 12, including layered SBS, asphalts, fillers, woven mats or aggregates that are layered in during the manufacturing process. More recently, such carriers 12 may be made of durable synthetic products like a gypsum course sandwiched between fiberglass mats. Other constructions may comprise rubberized asphalt reinforced with a non-woven polyester fabric, as well as multilayered polypropylene and polyethylene. Other organic and inorganic matrix designs are also fully compatible with the novel features of the subject invention. Thus, the carrier 12 can be manufactured from any of the known materials, provided the resulting construction is capable of fulfilling the basic requirements for any underlayment system in a roof construction.

The carrier 12 has a top surface 14 and a bottom surface 16. The top 14 and bottom 16 surfaces are bounded by opposing upper 18 and lower 20 long edges which are generally parallel to one another. The upper long edge 18 is adapted to be applied to a pitched roof construction at a higher elevation than that of the lower edge 20, hence the upper and lower designations for the long edges 18, 20 are indicative of their intended orientation when placed into service on a pitched roof. Although the distance between upper 18 and lower 20 long edges can be made to suit any particular application or market preference, in the preferred embodiment the distance is approximately 36 inches. Thus, the underlayment sheet 10 can be said to be approximately 36 inches wide, and of any convenient length.

Figure 2:
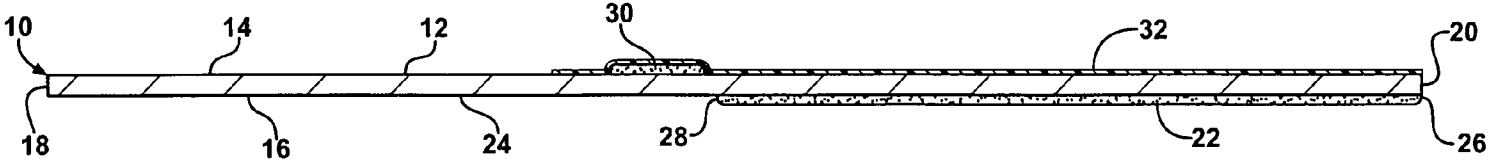
FIG. 2 is a cross-sectional view of the underlayment sheet as taken generally along lines 2-2 in FIG. 1.
Figure 7:
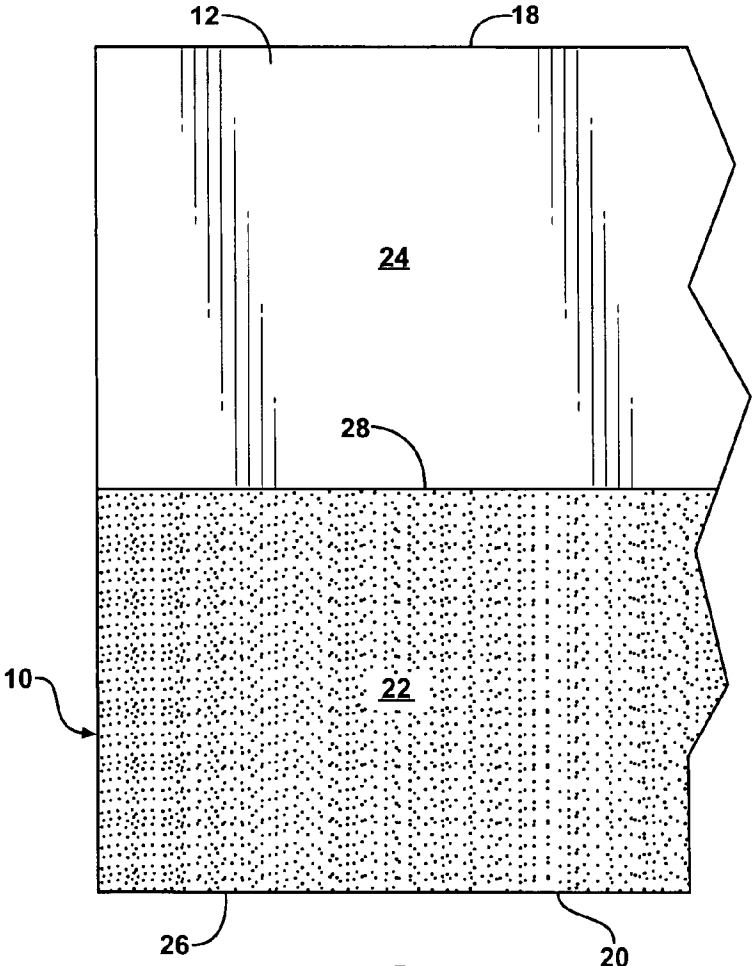
FIG. 7 is a bottom view of the subject underlayment sheet depicting the adhesive and non-adhesive sections.

A pressure sensitive adhesive section 22 is disposed generally continuously along the length of the bottom surface 16, adjacent the lower long edge 20, as best shown in FIGS. 2 and 7. The adhesive section 22 is especially adapted for surface-to-surface contact with the top surface 14 of a preceding one of the underlayment sheets 10 in an overlapping course configuration, as perhaps best shown in FIG. 5. The adhesive section 22 can be applied in continuous strip fashion by spraying, rolling or any other application technique during the manufacturing process. Furthermore, the composition of the pressure sensitive adhesive used in the adhesive section 22 can take any of the known forms, including those compounds currently in use for the peel and stick underlayment products. For example, the adhesive products and application techniques currently available from Polyglass U.S.A., of Fernley, Nev., can be used to create the adhesive section 22 for the present invention.

The bottom section 16 also includes a non-adhesive section 24 which extends continuously along the length of the carrier 12. The non-adhesive section 24 is perhaps best appreciated by reference to FIGS. 2 and 7. The non-adhesive section 24 is juxtaposed alongside the adhesive section 22 and is adapted for direct surface-to-surface contact with a roof deck.

In the preferred embodiment, the adhesive section 22 is generally evenly disbursed without any interrupting voids or open regions. The precise area over which the adhesive section 22 is applied to the bottom surface 16 is subject to some variation. In the preferred embodiment, however, the adhesive section 22 extends from a first margin 26 that is coextensive with the lower long edge 20, to a second margin 28 which is somewhere between the lower 20 and upper 18 long edges. The amount of surface area covered by the adhesive section 22 is generally indicative of the recommended overlap between courses in the underlayment system. As shown in FIGS. 1, 2 and 7, the second margin 28 may be positioned no greater than generally half way between the upper 18 and lower 20 long edges, which would effectively limit the minimum overlap to one-half the width of the carrier 12. Thus, if about one-half width overlap is desired, the second margin 28 can be set approximately 18 inches from the lower long edge 20 in a 36 inch wide roll. This, therefore, would result in the non-adhesive section 24 also being generally 18 inches wide. However, those skilled in the art will appreciate that in applications where less than one-half width overlap is required, or in situations where the waterproofing qualities can be relaxed, the width of the adhesive section 22 (i.e., the normal distance between the first 26 and the second 28 margins) can be reduced. In any event, the adhesive section 22 will remain proximate the lower long edge 20 on the bottom surface 16.

An optional bonding strip 30 extends continuously along the length of the top surface 14 of the carrier 12. This can be seen best in FIGS. 1, 2 and 6. The bonding strip 30 preferably consists of a pressure sensitive adhesive material identical or substantially identical to that used for the adhesive section 22 applied to the bottom surface 16. Unlike the adhesive section 22, however, the bonding strip 30 is but a narrow region which is applied centrally to the top surface 14. In the example of the 36 inch wide roll, the bonding strip 30 may be about 3 inches wide and spaced about 18 inches from the lower long edge 20 and about 15 inches from the upper long edge 18. Thus, as shown in FIG. 2, the bonding strip 30 is preferably at least partially offset from the adhesive section 22, in that the bonding strip 30 is proximate the upper long edge 18 whereas the adhesive section 22 is proximate the lower long edge 20.

When the underlayment sheet 10 is rolled into a tubular configuration for transportation and job site handling, it may be necessary to apply a disposable release film 32 over the top surface 14, as shown in FIG. 2. A generally non-stick plastic or waxed paper material, the release film 32 will prevent the bonding strip 30 from adhering to the adhesive section 22, when rolled. Furthermore, the release film 32 can help to keep the bonding strip 30 and the adhesive section 22 clean prior to its installment on a roof deck. The release film 32 is removed from the underlayment sheet 10 prior to application of the next course on the roof deck. In alternative configurations, the release film 32 may be applied to the adhesive section 22 on the bottom surface 16 which may be preferred if the optional bonding strip 30 is omitted.

Figure 3:
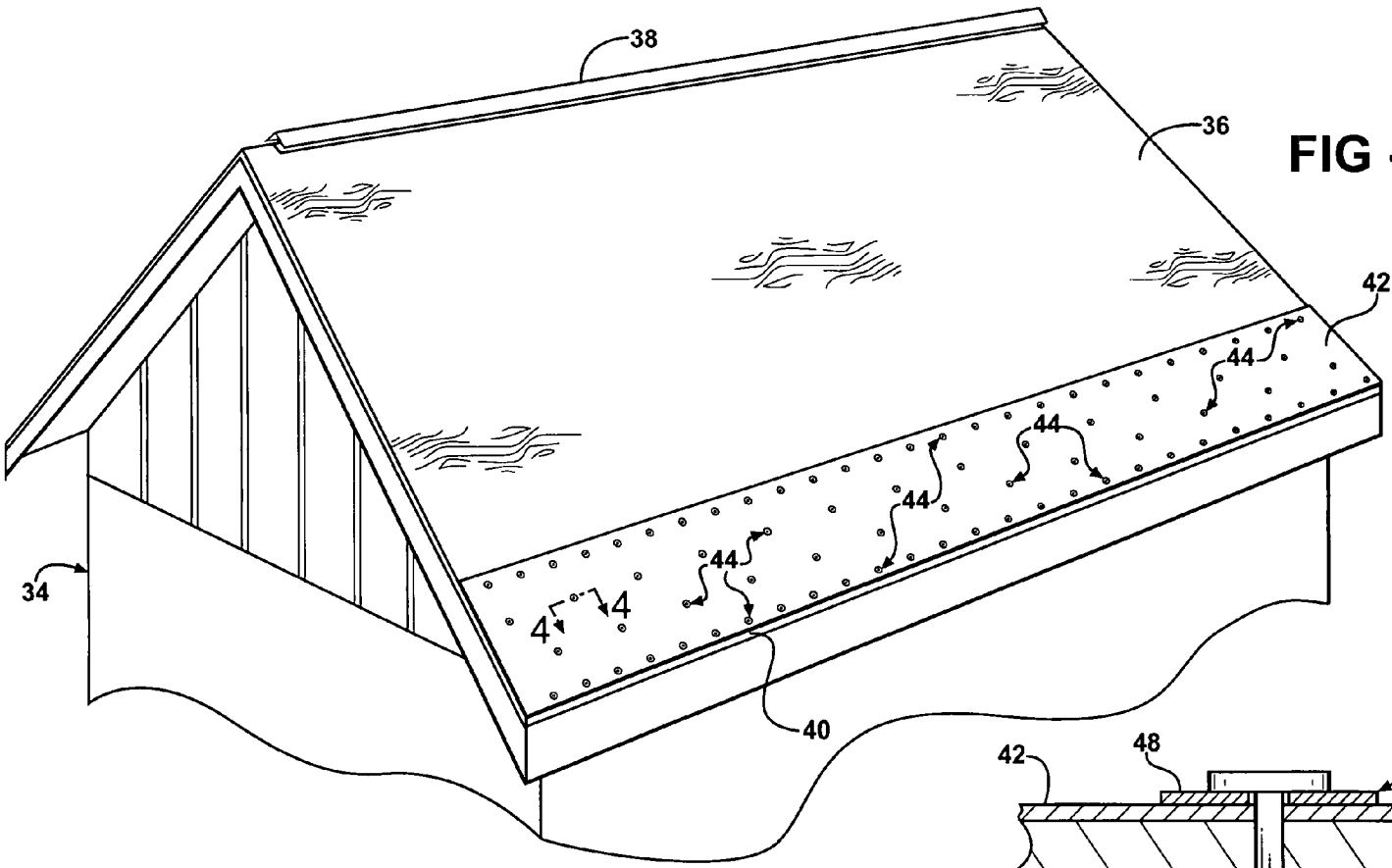
FIG. 3 is a simplified perspective view of a building structure having a roof with exposed roof decking and a starter course of non-adhesive underlayment material mechanically fastened along the lower edge of the roof deck.
Figure 4:
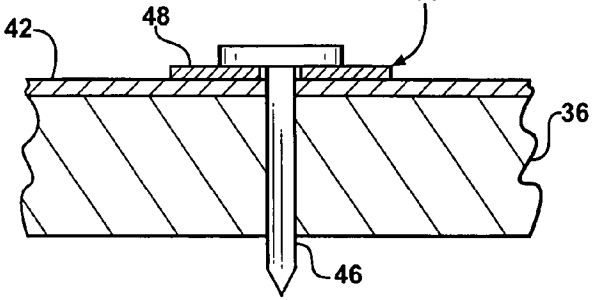
FIG. 4 is a cross-sectional view taken generally along lines 4-4 in FIG. 3 and depicting a preferred mechanical fastening technique for attaching the starter course to the roof deck.
Figure 5:
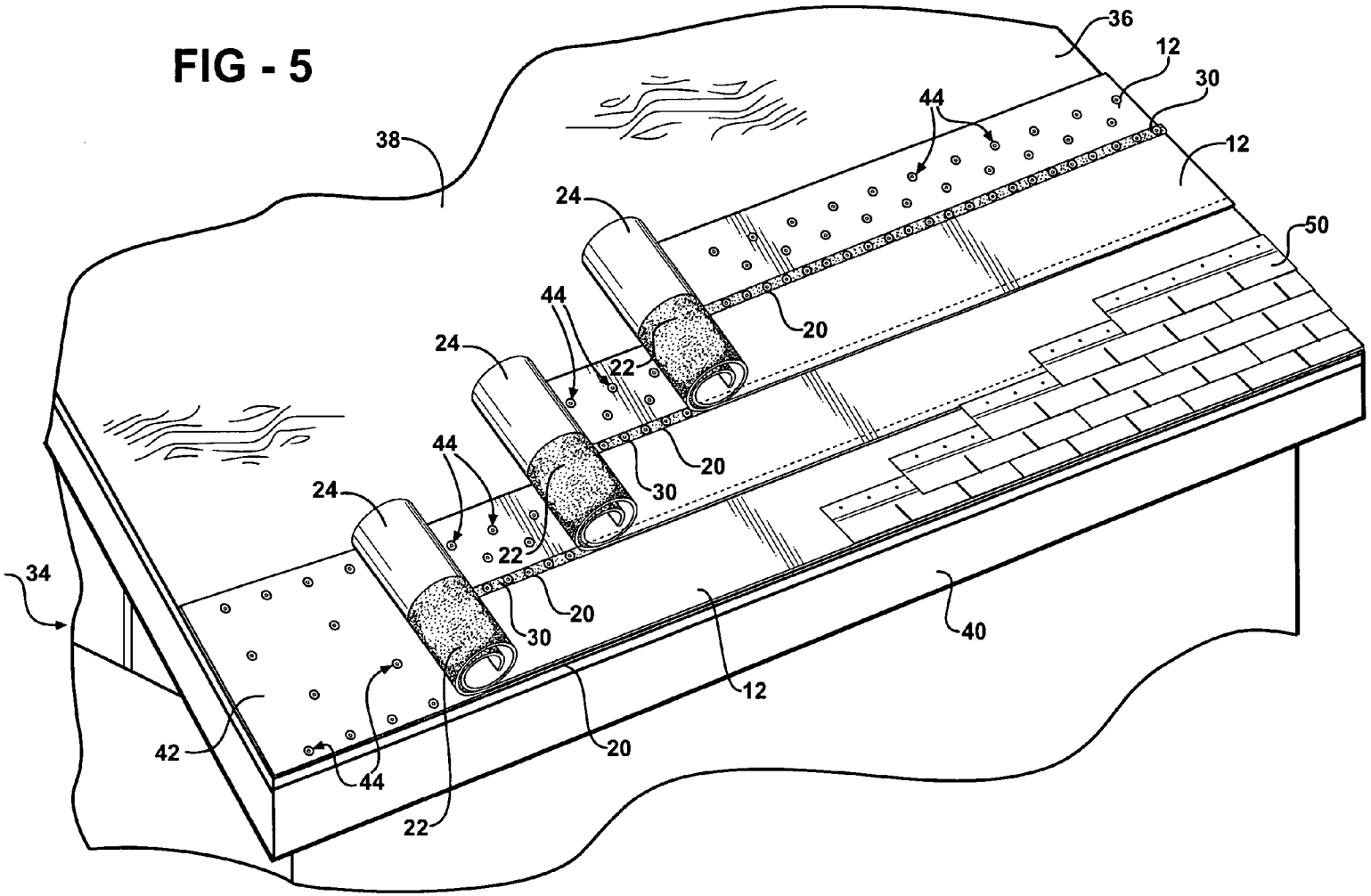
FIG. 5 is a perspective view enlarged from FIG. 3, and showing several courses of the subject underlayment sheets installed in overlapping fashion together with an exemplary roof covering of shingles depicted in the lower right corner thereof.

Referring now the FIGS. 3-5, a weather-resistant roof system for a building structure including the subject underlayment sheet 10 is shown and described. A building structure, generally indicated at 34, can be used for either commercial or residential applications and includes a sloping roof deck 36. Typically, the roof deck is made from plywood, oriented strand board, or other cellulose based sheet material affixed over beams, rafters or trusses. Nevertheless, new roof decking materials are continually introduced to the market and the subject underlayment sheet 10 could be applied to any such material which is now or may in the future be used for roof system applications. The roof deck 36 extends from a ridge or peak 38 at an elevated level down to an eave 40 or perhaps a valley or other low structural feature (not shown).

As described above, the subject underlayment system is intended to establish a weather-resistant membrane below the final roof covering and is typically applied in overlapping courses, although some applications may call for no covering overtop the underlayment system. Before the subject underlayment sheet 10 is applied, however, a starter course 42 is laid along the roof deck 36, parallel to the eave 40 or other low elevation feature of the roof deck 36. The starter course 42 may comprise the traditional felt-paper or other base sheet which is non-adhesive. The starter course 42 is mechanically attached to the roof deck 36 using tin tags 44, cap nails, regular roofing nails, screws or the like. In FIG. 4, a representative tin tag 44 is shown in general cross-section as taken from line 4-4 in FIG. 3. The tin tag 44 is comprised of a nail 46 below whose head is captured an enlarged washer 48. The shank of the nail 46 is embedded in the roof deck 36. The tin tags 44 are applied in regular intervals along the length of the starter course 42 as per local building code recommendations. In practice, the starter course 42 should be at least as wide as the width of the adhesive section 22 on the subject underlayment sheet 10. In the example illustrated in FIGS. 3 and 5, the starter course 42 has generally the same width as that of the underlayment sheet 10, which may be about 36 inches.

Figure 6:
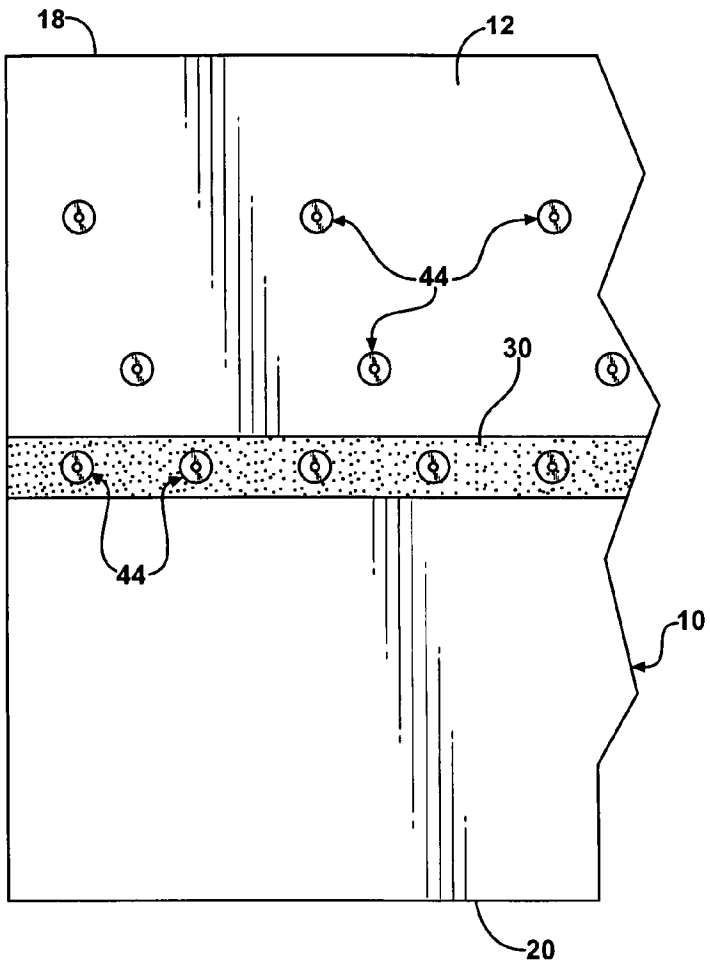
FIG. 6 is a top view of a length of the subject underlayment sheet showing a proposed tin tag spacing configuration.

After the starter course 42 has been installed, a first course of the subject underlayment sheet 10 is applied over top, with the lower long edge 20 of the underlayment sheet 10 generally coinciding with the lower edge of the starter course 42 in full overlapping condition. The adhesive section 22 of the underlayment sheet 10 adheres in surface-to-surface contact with the top surface of the starter course 42, thus retaining the first course of the underlayment sheet 10 in position while tin tags 44 (or other fastening devices) are placed through the non-adhesive section 24. FIG. 6 illustrates an exemplary spacing of tin tags 44 as placed through the subject underlayment sheet 10. Thus, the first course of the underlayment sheet 10 is fixed in position via the adhesive section 22 adhering to the underlying starter course 42, in combination with the tin tags 44 affixing the upper, non-adhesive section 24 mechanically to the roof deck 36.

After the first course of underlayment sheet 10 has been mechanically fastened to the roof deck 36, a second course of the underlayment sheet 10 is applied in a generally linear course, overlapping a parallel portion of the first underlayment sheet 10. This arrangement is shown by the cascading progression of layers in FIG. 5 wherein the second and subsequent courses of underlayment sheets 10 overlap (at least as far as the bonding strip 30 if present) the next adjacent underlying underlayment sheet 10. The second course and all subsequent courses of underlayment sheets 10 are likewise mechanically fastened to the roof deck 36 via tin tags 44, nails, screws, or any other mechanical fastening arrangement.

According to this system, only the non-adhesive sections 24 of the underlayment sheets 10 are permitted to touch the roof deck 36. In other words, the adhesive sections 22 in each underlayment sheet 10 are prevented from touching the roof deck 36 by the overlapping portion of the next adjacent underlayment sheet 10 or by the starter course 42. This arrangement results in a bonding of the overlapping parallel portions of underlayment sheets 10 to one another with the pressure sensitive adhesive in the collective adhesive sections 22, thereby establishing a durable, water-resistant joint over the entire roof deck 36. Furthermore, the optional bonding strip 30 provides an additional, tenacious, waterproof joint by touching in surface-to-surface fashion with the overlying adhesive section 22 of the next adjacent course of underlayment sheet 10.

In the preferred embodiment, wherein the adhesive section 22 spans the full 18 inches of a 36 inch wide roll, and wherein the tin tags 44 are applied in only the upper 18 inches of any roll, the adhesive section 22 will completely seal over all of the tin tags 44 in the course below, thereby enhancing weather resistance.

The subject underlayment sheet 10 provides the advantages of a self-adhering, water-resistant joint found in traditional peel and stick underlayment products, but overcomes their disadvantages by preventing any adhesive material from directly contacting the roof deck 36. Therefore, the roof deck 36 becomes water tight with but a single layer of underlayment material and requiring only one trip to the job site for the roofing contractor. According, the subject system requires less people to complete a roofing project, thereby reducing exposure to roofing risks.

As shown in FIG. 5, a roof covering 50 is applied over top of the finished underlayment system. The roof covering 50 may comprise any commercially available and locally applicable material, including shingles, sheet metal, clay or cement tiles, wood shakes, and the like. If and when, after years of use, a re-roofing job is required, the roof covering 50 together with the subject weather-resistant membrane can be removed, thereby exposing a fresh roof deck 36 which will be immediately prepared for the new roof application. The subject underlayment system thus provides for a full integration of the multiple courses of underlayment sheets 10 which is both water tight and weather-resistant, and friendly to subsequent repairs.

Figure 9:
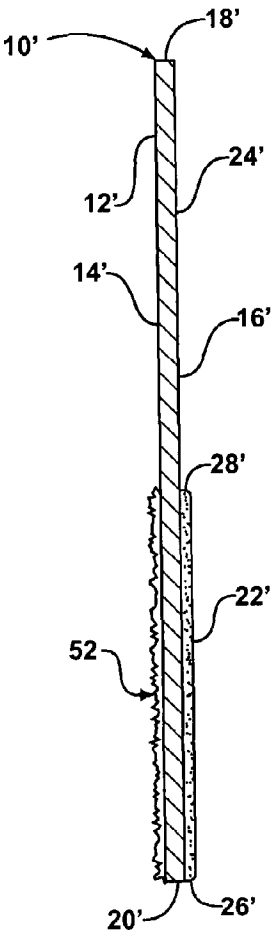
FIG. 9 is an end view taken generally from lines 9-9 in FIG. 8.
Figure 8:
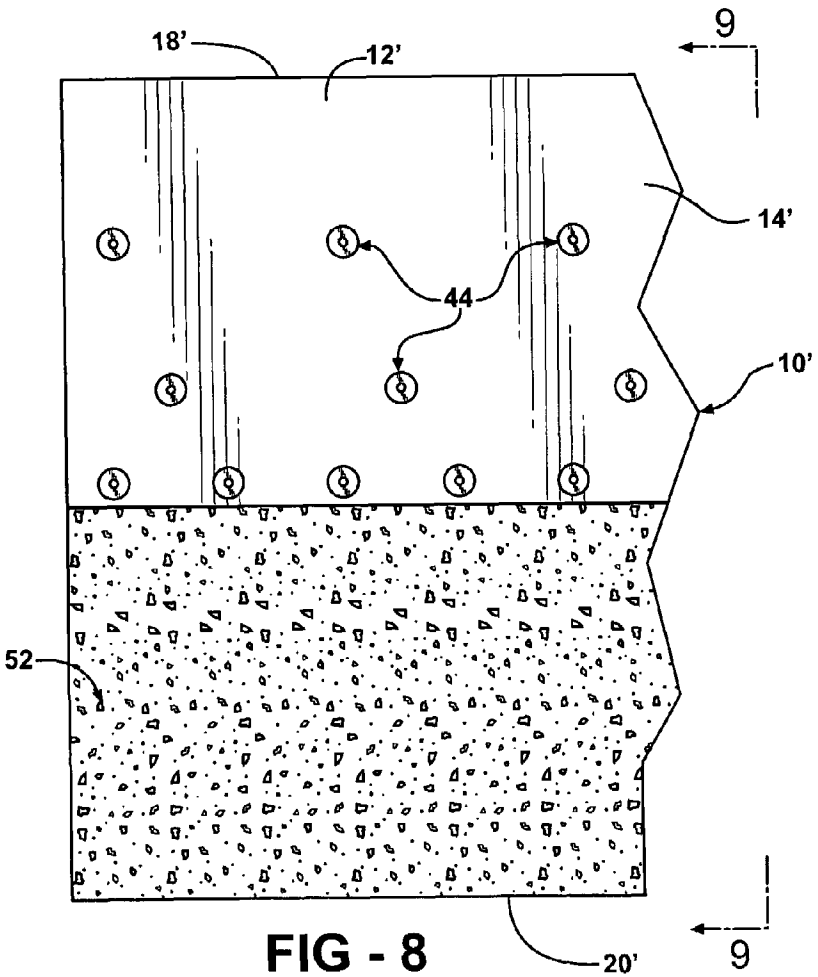
FIG. 8 is a top view of a length of the subject underlayment sheet according to an alternative embodiment.

Referring now to FIGS. 8 and 9, an alternative configuration of the subject underlayment sheet is generally indicated at 10'. In this alternative embodiment, features corresponding to those described above are indicated with like reference numerals and given a prime designation. In this embodiment, the optional bonding strip is omitted, however, it will be appreciated that the bonding strip could be incorporated into this embodiment if desired. A significant distinction of this embodiment is seen on the lower, exposed region of the upper surface 14'. To facilitate use of the underlayment sheet 10' as a final covering system, this region of the upper surface 14' is impregnated with a course aggregate material 52 to withstand direct exposure to the elements. That is, since this embodiment is intended for use without an over-application of shingles or the like, the portion of the upper surface 14' that will not be overlapped by the next successive course is treated with granules of the know type. The course aggregate material 52 covers a region generally co-extensive with and aligned over the adhesive section 22' on the bottom surface 16'. The upper half of the top surface 14' is left smooth, i.e., aggregate free, to provide a good bonding surface with the adhesive section 22' of the next course. Accordingly, when the alternative underlayment sheet 10' is applied over the roof deck in the manner shown in FIG. 5, the course aggregate material 52 is exposed and establishes a finished exterior surface.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. A weather-resistant roof system for a building structure, said roof system comprising:

a roof deck;

a plurality of underlayment sheets applied in overlapping courses upon said roof deck;

each of said underlayment sheets including an elongated flexible carrier having a top surface and a bottom surface, an adhesive section disposed generally continuously along the length of said bottom surface, and a nonadhesive section extending continuously along the length of said bottom surface juxtaposed alongside said adhesive section;

at least one of said underlayment sheets laying with said adhesive section thereof in surface-to-surface contact with said top surface of an adjacent one of said underlayment sheets and said non-adhesive section thereof in surface-to-surface contact with said roof deck;

a starter course disposed in surface-to-surface contact with said roof deck, said starter course having an upper surface and a lower surface, with said upper and lower surfaces being free of adhesives, such that said starter course does not adhesively adhere to said roof deck;

at least one of said underlayment sheets laying with said adhesive section thereof in surface to surface contact with said upper surface of said starter course; and a plurality of shingles disposed on said top of said underlayment sheets for establishing a durable exposed facade.

2. The roof system of claim 1 wherein said at least one underlayment sheet includes a bonding strip extending continuously along the length of said top surface thereof, said bonding strip in surface-to-surface contact with said adhesive section of an adjacent one of said underlayment sheets.

3. The roof system of claim 1 further including a plurality of mechanical fasteners extending through said underlayment sheets and anchored in said roof deck.

4. The roof system of claim 3 wherein said mechanical fasteners each have a head in pressing contact with said top surface and a shank embedded in said roof deck, each of said heads being sealed by said adhesive section of an adjacent one of said underlayment sheets.

5. A weather-resistant roof system for a building structure, said roof system comprising:

a roof deck;

a plurality of underlayment sheets applied in overlapping courses upon said roof deck;

each of said underlayment sheets including an elongated flexible carrier having a top surface and a bottom surface, an adhesive section disposed generally continuously along the length of said bottom surface, and a non-adhesive section extending continuously along the length of said bottom surface juxtaposed alongside said adhesive section;

at least one of said underlayment sheets laying with said adhesive section thereof in surface-to-surface contact with said top surface of an adjacent one of said underlayment sheets and said non-adhesive section thereof in surface-to-surface contact with said roof deck;

a starter course disposed in surface-to-surface contact with said roof deck, said starter course having an upper surface and a lower surface, with said upper and lower surfaces being free of adhesives, such that said starter course does not adhesively adhere to said roof deck;

at least one of said underlayment sheets laying with said adhesive section thereof in surface to surface contact with said upper surface of said starter course; and a plurality of tiles disposed on said top of said underlayment sheets for establishing a durable exposed facade.

6. The roof system of claim 5 wherein said at least one underlayment sheet includes a bonding strip extending continuously along the length of said top surface thereof, said bonding strip in surface-to-surface contact with said adhesive section of an adjacent one of said underlayment sheets.

7. The roof system of claim 5 further including a plurality of mechanical fasteners extending through each of said underlayment sheets and anchored in said roof deck.

8. The roof system of claim 7 wherein said mechanical fasteners each have a head in pressing contact with said top surface and a shank embedded in said roof deck, each of said heads being sealed by said adhesive section of an adjacent one of said underlayment sheets.

9. A weather-resistant roof system for a building structure, said roof system comprising:

a roof deck;

a plurality of underlayment sheets applied in overlapping courses upon said roof deck;

each of said underlayment sheets including an elongated flexible carrier having a top surface and a bottom surface, an adhesive section disposed generally continuously along the length of said bottom surface, and a non-adhesive section extending continuously along the length of said bottom surface juxtaposed alongside said adhesive section;

at least one of said underlayment sheets laying with said adhesive section thereof in surface-to-surface contact with said top surface of an adjacent one of said underlayment sheets and said non-adhesive section thereof in surface-to-surface contact with said roof deck;

a starter course disposed in surface-to-surface contact with said roof deck, said starter course having an upper surface and a lower surface, with said upper and lower surfaces being free of adhesives, such that said starter course does not adhesively adhere to said roof deck;

at least one of said underlayment sheets laying with said adhesive section thereof in surface to surface contact with said upper surface of said starter course; and a plurality of shakes disposed on said top of said underlayment sheets for establishing a durable exposed façade.

10. The roof system of claim 9 wherein said at least one underlayment sheet includes a bonding strip extending continuously along the length of said top surface thereof, said bonding strip in surface-to-surface contact with said adhesive section of an adjacent one of said underlayment sheets.

11. The roof system of claim 9 further including a plurality of mechanical fasteners extending through each of said underlayment sheets and anchored in said roof deck.

12. The roof system of claim 11 wherein said mechanical fasteners each have a head in pressing contact with said top surface and a shank embedded in said roof deck, each of said heads being sealed by said adhesive section of an adjacent one of said underlayment sheets.

13. A weather-resistant roof system for a building structure, said roof system comprising:

a roof deck;

a plurality of underlayment sheets applied in overlapping courses upon said roof deck;

each of said underlayment sheets including an elongated flexible carrier having a top surface and a bottom surface, an adhesive section disposed generally continuously along the length of said bottom surface, and a non-adhesive section extending continuously along the length of said bottom surface juxtaposed alongside said adhesive section;

at least one of said underlayment sheets laying with said adhesive section thereof in surface-to-surface contact with said top surface of an adjacent one of said underlayment sheets and said non-adhesive section thereof in surface-to-surface contact with said roof deck;

a starter course disposed in surface-to-surface contact with said roof deck, said starter course having an upper surface and a lower surface, with said upper and lower surfaces being free of adhesives, such that said starter course does not adhesively adhere to said roof deck;

at least one of said underlayment sheets laying with said adhesive section thereof in surface to surface contact with said upper surface of said starter course; and a plurality of metal roofing disposed on said top of said underlayment sheets for establishing a durable exposed façade.

14. The roof system of claim 13 wherein said at least one underlayment sheet includes a bonding strip extending continuously along the length of said top surface thereof, said bonding strip in surface-to-surface contact with said adhesive section of an adjacent one of said underlayment sheets.

15. The roof system of claim 13 further including a plurality of mechanical fasteners extending through each of said underlayment sheets and anchored in said roof deck.

16. The roof system of claim 15 wherein said mechanical fasteners each have a head in pressing contact with said top surface and a shank embedded in said roof deck, each of said heads being sealed by said adhesive section of an adjacent one of said underlayment sheets.

* * * * *